United States Patent [19]

Pelchat

[11] 4,186,524

[45] Feb. 5, 1980

[54] POWER ACTUATOR FOR PIVOTABLE WINDOW

[75] Inventor: Paul F. Pelchat, Canton, Mich.

[73] Assignee: General Motors Corporation, Detroit, Mich.

[21] Appl. No.: 896,309

[22] Filed: Apr. 14, 1978

[51] Int. Cl.[2] ..... E05F 11/00

[52] U.S. Cl. ..... 49/324; 49/325; 49/357

[58] Field of Search ..... 49/322, 349, 357, 325, 49/324; 279/16

[56] References Cited

U.S. PATENT DOCUMENTS

| | | | |
|---|---|---|---|
| 2,475,385 | 7/1949 | Frisco | 279/16 |
| 2,528,572 | 11/1950 | Bancroft | 49/324 |
| 4,074,463 | 2/1978 | Colanzi | 49/352 |

FOREIGN PATENT DOCUMENTS

| | | | |
|---|---|---|---|
| 2004606 | 11/1969 | France . | |
| 838094 | 6/1960 | United Kingdom | 49/324 |

*Primary Examiner*—Kenneth Downey

*Attorney, Agent, or Firm*—R. L. Phillips

[57] ABSTRACT

A vehicle power window actuator for pivoting a glass view panel about an axis by means of back-and-forth linear movement of a wire cable. The wire cable has a jack screw portion swaged to one end engaging a gear which is rotated by an electric motor to produce linear movement of the cable. The other end of the wire cable is swage-attached to a rigid curved rod terminating in a ball-shaped end portion. The curved rod is housed in an arcuate hollow support assembly which is attached to the vehicle body adjacent the movable edge portion of the window panel so as to direct the end portion of the curved rod against the panel. A connector assembly between the end portion of the curved rod and the window accommodates linear movement of the ball-shaped portion in a direction parallel with the plane of the glass as the window pivots outward. In addition, the end portion moves with and rotates with respect to the glass. The connection compensates for substantial misalignment which often occurs between the axis of the curved rod and the attachment of the connector assembly to the window.

3 Claims, 6 Drawing Figures

POWER ACTUATOR FOR PIVOTABLE WINDOW

This invention relates to powered window actuators and, in particular, to a remotely powered actuator including a relatively flexible cable movable in the linear direction and connected to a movable portion of a glass panel.

It is often desirable for ventilation purposes to provide a powered rear vent window for vehicles which is actuated from the driver's seat in the vehicle. A problem in the past has been the high cost resulting from the relative complexity of such powered vent window openers. The subject invention provides a simple and relatively inexpensive powered window actuator which utilizes a unique connector assembly between the force-transmitting push-pull cable actuator and the window glass. The connector mounts to the window and moves therewith while also accommodating the ever-changing angle between the plane of the glass and the axis of the linear cable actuator which is contained and guided by a housing fixed to the vehicle. In addition, this connection accommodates a sufficiently great range of dimensional non-alignment between the center of the window-carried connector assembly and the axis of the linear cable actuator which is contained and guided by a housing fixed to the vehicle. In addition, this connection accommodates a sufficiently great range of dimensional non-alignment between the center of the window-carried connector assembly and the axis of the linear cable actuator which determines the engagement point with the glass panel.

A still further feature of the subject power window actuator is the relative compactness of the assembly and, particularly, the window end of the cable actuator. The end of the linear cable actuator is curved in about a 90-degree arc and contained in an arcuate housing. The housing is attached to the body adjacent the movable edge portion of the window. The 90-degree arcuate housing thus extends about the corner of the window casing and lies fairly flat against the vehicle body. An advantage is that it does not project into the passenger compartment a significant amount.

From the arcuate housing, the wire cable within a sheath extends downward and rearward into the trunk compartment, where the electric motor and gear portions are located. When the motor is activated by switch and circuit means from the operator position or elsewhere, the motor quietly performs the window opening or closing function.

Other advantages and features of the present invention will be more readily apparent from a reading of the following detailed description, reference being had to the accompanying drawings in which a preferred embodiment is illustrated.

Figure 1:
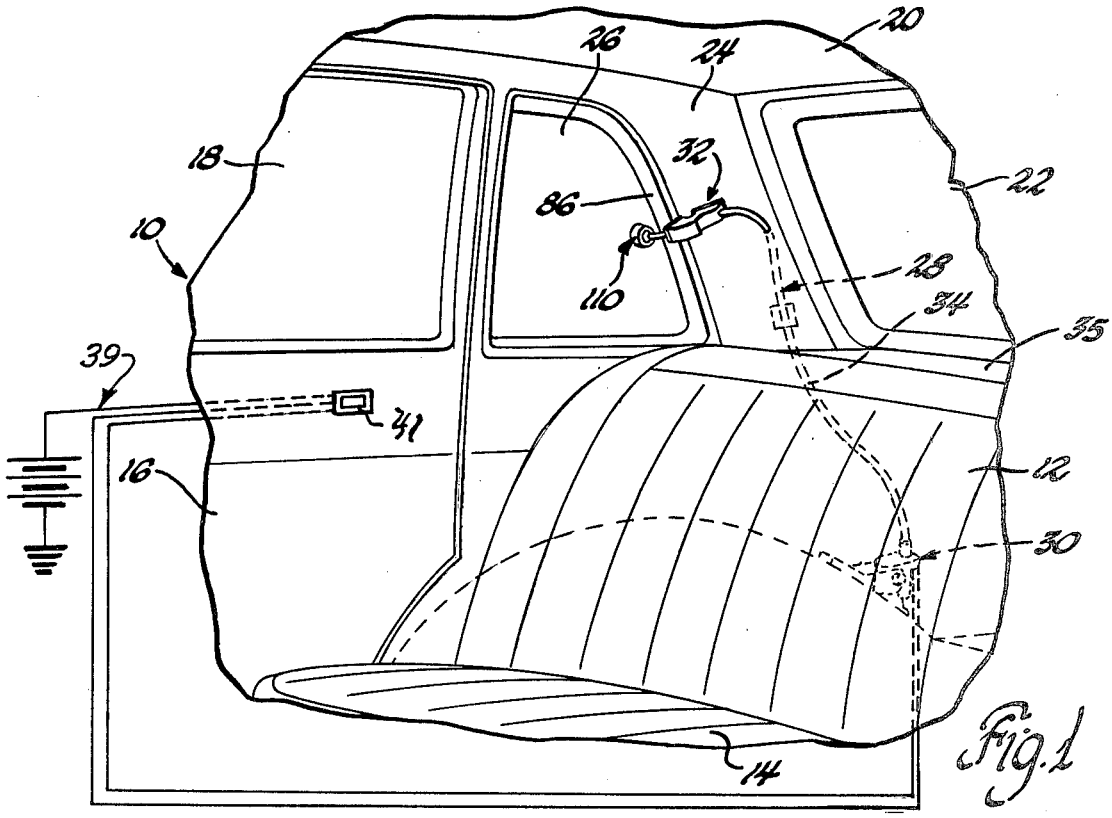
FIG. 1 is a fragmentary and perspective view of the rear seat portion of a vehicle passenger compartment revealing the window actuator arrangement.

In FIG. 1 of the drawings, a portion of a vehicle 10 is illustrated and, specifically, the rear seat portion of the passenger compartment is shown, including a rear seat back 12 and rear seat cushion 14. Access is by way of a rear door 16 which also includes a glass view portion or window 18. The interior surface portion of the roof 20 is also visible. A fixed rear window 22 provides a view to the rear of the vehicle and the body panel 24 located between the window 18 and rear window 22 provides a vent window 26. Vent window 26 is mounted to swing laterally outward with respect to the body about an axis along the forward edge of the window.

Figure 2:
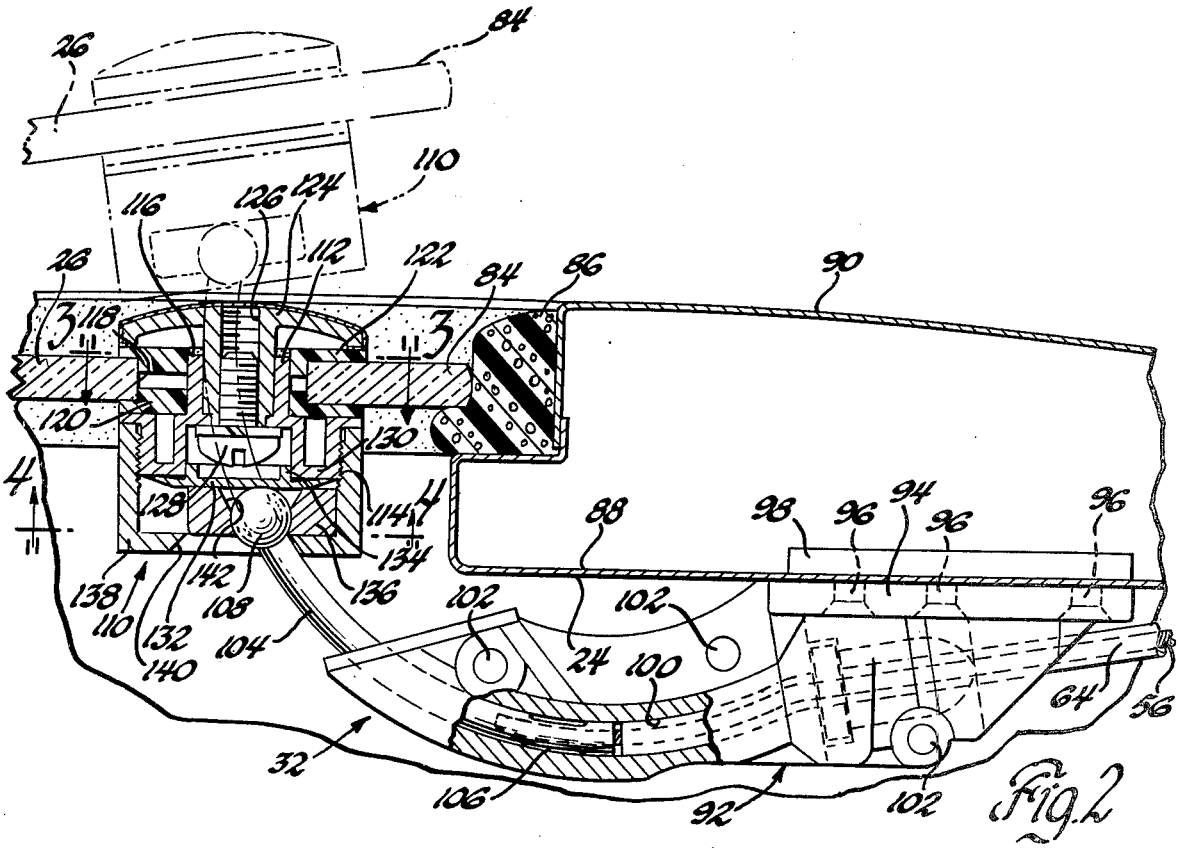
FIG. 2 is an enlarged and partially sectioned view of the connection between the movable rear portion of the window panel with the connector assembly of the actuator mounted thereon.

The swinging movement of the rear vent window 26 is shown in FIG. 2 and is controlled by the linear window actuator 28 which includes a trunk-mounted electric motor and gear 30 and a window connector portion 32 is adapted to be attached to the body panel portion 24. A sheathed linear wire cable 34 extends between 30 and 32 through the body components and the rear shelf 35 and into the trunk area.

Figure 5:
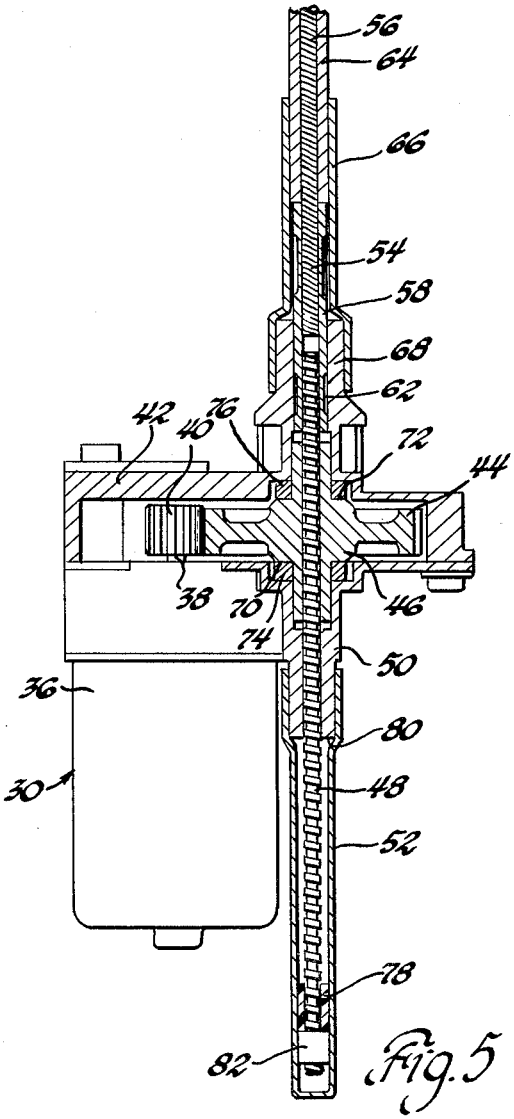
FIG. 5 is a sectioned view through the motor and gear assembly which is located in the trunk in FIG. 1.
Figure 6:
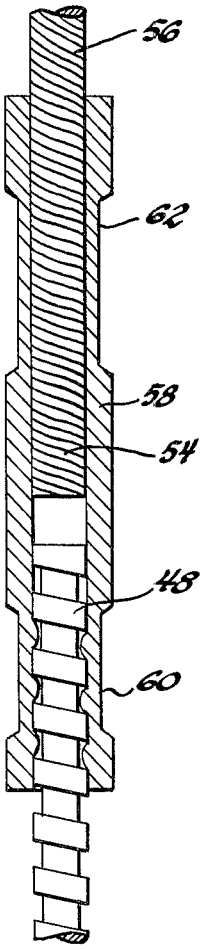
FIG. 6 is a greatly enlarged view of the swage connection between the flexible wire cable and the jack screw portion shown in FIG. 5.

As best shown in FIGS. 5 and 6, the motor and gear assembly 30 includes a small permanent magnet-type electric motor 36 which has an output shaft 38 on which a small gear 40 is mounted. The motor 36 is reversible and as shown in FIG. 1 has circuit means 39 associated therewith, including switch means 41 for selectively activating the motor alternately in either direction at a switch location remote from the motor. Gear 40 is enclosed within a housing 42 connected to the electric motor 36. Gear 40 meshes with a larger diameter and much greater toothed drive gear 44 which also includes an internally threaded hub portion 46. The internally threaded hub portion 46 threadedly engages a jack screw member 48 which is guided in its linear motion by elongated housing members 42 and 50. Also, a deep cup-shaped member 52 encloses the lower extreme end of the jack screw 48 when in the closed window position shown in FIG. 5. An enlarged view of the jack screw 48 is shown in FIG. 6. In that view, jack screw 48 is shown connected to the end 54 of a relatively flexible wire cable 56. A collar member 58 of relatively malleable metal material engages the adjacent ends of the jack screw and the wire cable. Impressions 60, 62 in the member 58 are formed by application of a crimping force during a swaging operation. This rigidly clamps the collar portion 58 to both the jack screw 48 and the end 54 of cable 56 to provide an extremely stable and rigid connection therebetween. Thereby, when linear forces are applied to the jack screw by the gear 44, the cable 56 is moved smoothly within a sheath 64 which is revealed in FIG. 5. The wire cable sheath or housing 64 is attached to an end member 66 which in turn is secured to a portion 68 of the housing 42.

The large drive gear 44 has annular shoulder surfaces 70, 72 at either end of the hub 46 which engage thrust washers 74, 76 located between the shoulders and the housing portions 42, 50. The washers 74, 76 may be made of lubricant bearing or other low frictional material. While the gear 44 is free to rotate within the space formed by housing members 42 and 50, it may not move axially. Consequently, when the motor 36 rotates gear 40, gear 44 is rotated therewith and the internally threaded hub portion 46 produces linear motion of the jack screw 48 within the housings 42 and 50. Extreme upward movement of the jack screw 48 is limited by engagement between a rubber cushioned stopper member 78 and a surface 80 on the bottom end of housing 50. The stopper 78 is supported on the lower end of the jack screw 48 by a member 82 which is securely attached thereto. Downward movement of the jack screw 48 is limited by the closing of the window panel which is operably attached to the other end of cable 56.

In FIG. 2, the window panel and cable connector assembly are shown. The window 26 is pivoted along the forward edge as seen in FIG. 1 and the movable rearward edge 84 tightly engages a weather strip member 86 when closed. Weather strip 86 is attached by adhesive to the juncture between inner and outer body panels 88, 90 which make up the roof body portion 24 in FIG. 1. The upper end of cable 56 engages an arcuately shaped housing assembly 92 which includes a mounting flange portion 94. Portion 94 is attached by fasteners 96 to the inner panel 88 by means of a stiffener or backup plate 98. The assembly 92 provides a tunnel portion 100 which encircles the end of sheath portion 64. The housing 92 is composed of upper and lower members which are capable of separation and clamp together by means of fasteners 102. Within housing 92 an end of a curved rod 104 is attached to the end of cable 56. Rod 104 is freely movable within the tunnel 100 of actuator 92. The curved rod 104 is provided with an internal opening at one end and crimped or swaged to the end of the flexible cable 56 as indicated by the annular indentation 106. The other end of the curved rod 104 extends from housing 92 and is formed with a spherical configuration or a ball end 108. The ball end 108 is engaged and thereby attached to the glass panel 26 by a connector assembly 110.

Figure 3:
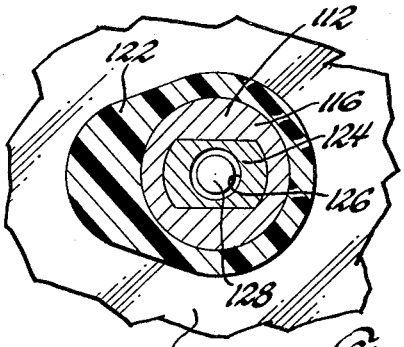
FIG. 3 is a sectioned view taken along section line 3—3 in FIG. 2 and looking in the direction of the arrows.
Figure 4:
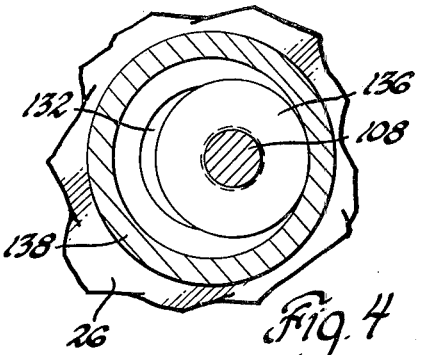
FIG. 4 is a sectioned view taken along section line 4—4 in FIG. 2 and looking in the direction of the arrows.

Specifically, the connector assembly 110 includes a retainer member 112 which has a threaded outer surface 114 and an inner hub portion 116 extending through an opening 118 in the glass panel. Between the hub portion 116 and the edge surface of the opening 118, are inserted two spacer members 120, 122. The member 122 is shown in cross section in FIG. 3. The retainer 112 is secured by a decorative nut assembly 124 which engages member 122 at its outer peripheral edge while a fastener 128 engages an internally threaded portion 126.

The retainer 112 provides an annular portion 130 on which a combination spring-washer and table 132 is supported. An annular flange portion 134 of member 132 engages the inner diameter recess of the retainer portion 130 to position the member 132 thereon. An annular ferrule 136 is in sliding engagement with table 132. The members 132 and 136 are held together and against the portion 130 of the retainer 112 by a cup-shaped and nut-like cap member 138 which has an internally threaded portion adapted to engage the threads 114 of the retainer. The member 138 is provided with a relatively large opening 140 in its end surface through which the curved rod 104 extends. The opening 140 is, however, smaller than the outer dimensions of member 136. Furthermore, the ferrule 136 has a tapered central opening 142 which engages the surface of the ball portion 108 to connect the rod 104 positively to the assembly 110 while the rod is being moved away from the glass panel in a closing movement. The position shown in the phantom lines is an open position while the closed position is revealed by solid lines. When rod 104 is moving outward from the assembly 92 in an opening mode, the ball portion 108 engages the table member 132 to push the movable edge portion 84 and cause pivoting movement of the glass 26 to the more open alternate position shown in FIG. 2.

As shown in FIG. 2, the relative angular orientation changes between the glass plane and the axis of the end of rod 104 during opening. It can also be readily understood that when rod 104 moves outward in an opening operation, the point of engagement between the ball portion 108 and the member 132 shifts in the forward direction. Simultaneously, it is apparent that rotation of the ball portion 108 takes place. The relationship between the rod 104 and relatively large opening 140 in the nut member 138 permits this simultaneous sliding and rotative action. This motion is accompanied by sliding movement of the ferrule member 136 across the surface of member 132. During a closing movement, the reverse in simultaneous rotative and sliding movement occurs as the ball portion 108 transmits an inward closing force on the window 26 through members 136, 138.

A still further feature of the subject connector is the specific formation of the spring-washer member 132 whose peripheral outer edge extends so as to first engage portion 130 of member 112 at its extreme outer edge. As a load is applied, the midportion moves inward as the edge springs against the retainer 112, thus providing a cushioning effect for the movement of the member 104 and ball portion 108. The arrangement shown and described heretofore also has another inherent advantage in that the connection between the rod 104 and the glass-mounted connector assembly 110 can accommodate a relatively wide range of alignment variations therebetween caused by tolerance stack-up in the mounting of member 92 and in the hinge mounting of the glass 26 or because of other reasons.

Although only one embodiment has been illustrated, modifications may be made to the powered actuator without falling outside the scope of the invention as defined by the following claims.

What is claimed is as follows:

1. A remotely controlled and powered actuator to move a free edge portion of a vehicle window between open and closed positions about an opposite hinge-mounted edge portion comprising:

reversible electric motor means and circuit means associated therewith, including switch means for selectively activating the motor alternately in either direction from a switch location remote from the motor;

gear means including a small gear driven by said electric motor and a larger gear meshed therewith, having an internally threaded hub portion and permitted to rotate but not move axially with respect to the threaded hub portion;

an elongated jack screw threadably extending through the hub portion and movable axially therefrom by means of the rotation of threaded hub portion of the larger gear;

a sheathed motion and linear force transmitter of elongated configuration, including a relatively flexible cable with one end securely attached to said jack screw;

an arcuately shaped and rigid rod member having a ball-shaped end with its opposite end securely attached to the other end of the cable;

a curved housing means defining a curved tunnel therein for housing and guiding said rod member in movement back and forth in said tunnel;

said housing means being fixedly mounted adjacent the free edge of the vehicle window so that the ball end of the rod member extends toward the plane of the vehicle window;

a connector assembly mounted to the free edge of the vehicle window and including a flat surface on which said ball end may slide and rotate thereagainst as the window moves between opening and closing positions;

said connector assembly further including means to positively secure the ball end including a ferrule encircling said arcuate rod by an opening smaller than the ball end diameter and a cap member extending over the ferrule to hold it and said ball end against said flat surface, said cap member having an opening through which said rod extends sufficient to permit adequate lateral sliding movement in any direction of the ball end and ferrule caused by changes in the angular relationship between the plane of the window and the axis of the arcuate rod but insufficient to permit movement of said ferrule therethrough.

2. An improved remotely controlled and powered vehicle window actuator for moving a free edge of a window between open and closed positions about an opposite hinge-mounted edge portion including an electric motor power source and gear means with an interiorly threaded hub portion, an improved linear motion and force transmitter, comprising:

an elongated and rigid jack screw threadably extending through the hub portion and movable axially therefrom by rotation of the gear;

a sheathed wire cable of elongated configuration and relatively flexible nature, one end of which is swage-connected to an end of said jack screw; an arcuately shaped and rigid rod member having a ball-shaped end with its opposite end securely swage-connected to a second end of said wire cable;

housing means for guiding said arcuately shaped rod in back-and-forth movements caused by relative displacement of said jack screw with respect to the gear;

connection means between the ball end of the arcuate rod and the free edge portion of the window, including a flat table surface parallel to the plane of the window on which the ball end is free to slide and rotate in any direction a ferrule secured about the ball end and a cap having an enlarged opening therein extending over said ferrule; to positively hold the ball end adjacent the table surface, particularly during window closing movement when a force on the arcuate rod and the ball end is in a direction generally away from the window plane.

3. A connector assembly between the movable edge of a hinge-mounted panel and a linearly movable actuator having a rigid force-transmitting member terminating in an enlarged ball-shaped end, comprising:

a member secured to the movable edge of the panel and supporting a substantially flat table-like surface generally parallel to the plane of the panel, a ferrule with a central opening smaller than the diameter of the ball-shaped end encircling the rigid force-transmitting member, cap means extending over said ferrule and secured to said table-supporting member having an opening therein through which said force-transmitting member extends large enough to permit adequate lateral sliding movement in any direction of the ferrule and ball-shaped end on the table surface caused by changes in the angular relationship between the plane of the window and the axis of the arcuate rod but not large enough to permit movement of said ferrule therethrough.

* * * * *